US006409219B1

(12) United States Patent
Broome et al.

(10) Patent No.: US 6,409,219 B1
(45) Date of Patent: Jun. 25, 2002

(54) DOWNHOLE SCREEN WITH TUBULAR BYPASS

(75) Inventors: Todd Broome, The Woodlands; Benn Voll; Perry Douglas Baycroft, both of Houston, all of TX (US); Elmer Richard Peterson, Lafayette, LA (US); Bobby Edward Hall, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/439,797

(22) Filed: Nov. 12, 1999

(51) Int. Cl.[7] ..... F16L 39/00
(52) U.S. Cl. ..... 285/3; 285/93; 285/124.1
(58) Field of Search ..... 166/242.3, 242.6; 285/93, 124.1–124.5, 3

(56) References Cited

U.S. PATENT DOCUMENTS

| | | | | | |
|---|---|---|---|---|---|
| 386,751 | A | * | 7/1888 | Loomis | 285/124.1 |
| 1,547,461 | A | * | 7/1925 | Steele | 285/124.1 |
| 2,054,859 | A | * | 9/1936 | Kitching | 285/124.1 |
| 2,178,931 | A | * | 11/1939 | Crites et al. | 285/124.1 |
| 4,688,831 | A | * | 8/1987 | Viehmann | 285/137.1 |
| 4,945,991 | A | | 8/1990 | Jones | 166/278 |
| 5,082,052 | A | | 1/1992 | Jones et al. | 166/51 |
| 5,113,935 | A | | 5/1992 | Jones et al. | 166/51 |
| 5,217,071 | A | * | 6/1993 | Ferry et al. | 166/242.3 |
| 5,341,880 | A | | 8/1994 | Thorstensen et al. | 166/278 |
| 5,390,966 | A | | 2/1995 | Cox et al. | |
| 5,417,284 | A | | 5/1995 | Jones | 166/280 |
| 5,419,394 | A | | 5/1995 | Jones | 166/51 |
| 5,476,143 | A | | 12/1995 | Sparlin et al. | 166/233 |
| 5,515,915 | A | | 5/1996 | Jones et al. | 166/51 |
| 5,634,671 | A | * | 6/1997 | Watkins | 285/18 |
| 5,868,200 | A | | 2/1999 | Byrant et al. | |
| 5,992,893 | A | * | 11/1999 | Watkins | 285/18 |

FOREIGN PATENT DOCUMENTS

EP 622 523 A2 4/1994

* cited by examiner

*Primary Examiner*—Eric K. Nicholson
(74) *Attorney, Agent, or Firm*—Steve Rosenblatt

(57) ABSTRACT

A system for preferable use in gravel packing is disclosed which includes a plurality of transport tubes which are mounted outside of gravel pack screens. The multiplicity of shunt tubes cover a particular zone so that the tubes have a varying length to deposit gravel at different portions of the zone. The tops of the tubes are preferably sealed until ready for use and activated by applied pressure. In the preferred embodiment, rupture discs are found at the tops of each of the tubes, set for different pressures so as to open up the transport tubes to the lower most portion of a particular zone and later in sequence to the higher-most portion. The transport tubes are affixed to each section of pipe and are made up when two sections of pipe are made up to alignment marks. When the marks are aligned, the transport tube segments from each pipe section are in an aligned and sealed relation while the tool joint is properly torqued.

21 Claims, 4 Drawing Sheets

DOWNHOLE SCREEN WITH TUBULAR BYPASS

FIELD OF THE INVENTION

The field of this invention relates to bypass systems for downhole screens, particularly where the bypass systems have a variety of applications.

BACKGROUND OF THE INVENTION

Downhole screens are frequently used to prevent solids from being produced from the formation. Typically, sand is delivered to the annular space around the screens in the well bore with the object being to fill up the annular space with sand or other materials generally referred to as "gravel." Many times the delivered gravel can bridge, which results in bare spots around the screens and an ineffective gravel packing operation. Various types of systems have been developed in the past to address the inefficiency of the gravel delivery around an annular space in a screen downhole. Various solutions have approached the problem from the perspective of addition of various shunt tubes. Typical of these approaches are U.S. Pat. Nos. 5,417,284; 5,515,915; 4,945,991; 5,419,394; 5,341,880; 5,476,143; 5,113,935; and 5,082,052.

The apparatus and method of the present invention is intended to address some of the shortcomings found in the prior art solutions mentioned above. One problem that is encountered in making long shunt tubes that span a variety of joints is the ability to connect the shunt tube from one joint to the next while having the ability to make up each joint. Jumper lines to connect shunt tubes around tool joints presented an inefficiency in assembly of prior designs. One reference described above involved a pushed together design that was cumbersome and required clamping devices for each joint. Yet other designs used tubes with multiple perforations along their length, all of which are subject to clogging without being able to deliver the gravel along the length of the shunt tube as suggested in the references. Accordingly, one of the objectives of the present invention is to be able to use a technique with bypass tubes while at the same time allowing quick assembly to the proper amount of torque. Another objective of the present invention is to eliminate jumper lines around tool joints and to present a way of connecting the bypass tubes with the tool joints when the threaded connections in the tool joints are made up. Another objective of the present invention is to keep the bypass tubes isolated from gravel until they are ready to be used. Yet another objective of the present invention is to deploy a multiplicity of bypass tubes so that delivery of gravel can occur at multiple locations in a given zone. Yet another objective of the present invention is to stagger the availability of tubes on a bottom up order so that gravel can be deposited from the lower-most point to a higher-most point in sequence. Another objective of the present invention is to allow the bypass tubes to carry a signal or power transmitting devices such as fiber optic cable to obtain data from the well bore and transmit it to the surface. Those and other objectives of the present invention will readily apparent to those skilled in the art from a review of the preferred embodiment which appears below.

SUMMARY OF THE INVENTION

A system for preferable use in gravel packing is disclosed which includes a plurality of transport tubes which are mounted outside of gravel pack screens. The multiplicity of transport tubes cover a particular zone so that the tubes have a varying length to deposit gravel at different portions of the zone. The tops of the tubes are preferably sealed until ready for use and activated by applied pressure. In the preferred embodiment, rupture discs are found at the tops of each of the tubes, set for different pressures so as to open up the transport tubes to the lower most portion of a particular zone and later in sequence to the higher-most portion. The transport tubes are affixed to each section of pipe and are made up when two sections of pipe are made up to alignment marks. When the marks are aligned, the transport tube segments from each pipe section are in an aligned and sealed relation while the tool joint is properly torqued.

DETAILED DESCRIPTION OF THE PREFERRED EMBODIMENT

Figure 1A:
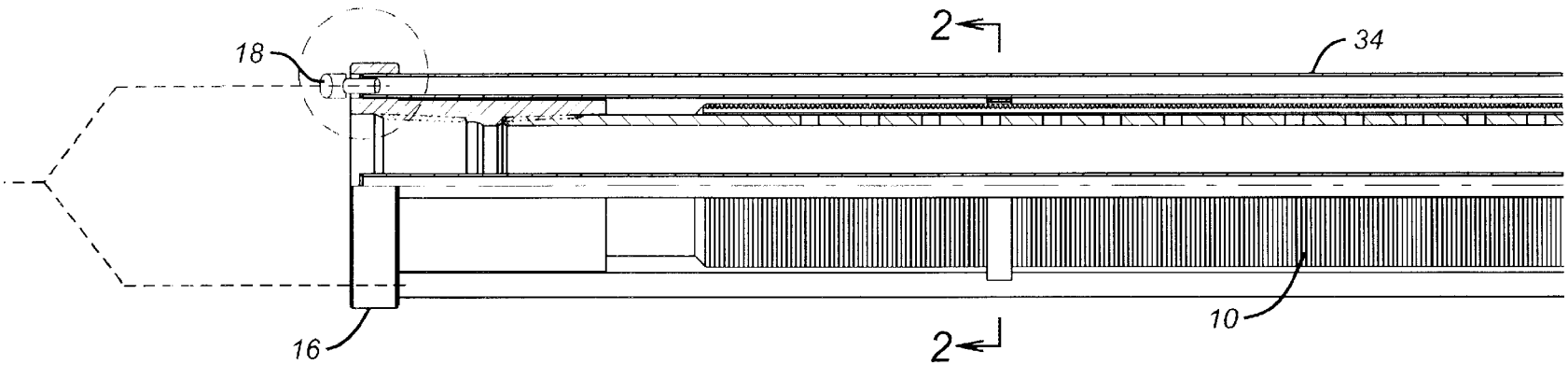
FIGS. 1*a* through *d* represent a cross-section of a gravel packing screen assembly showing the transport tubes of the present invention.
Figure 2:
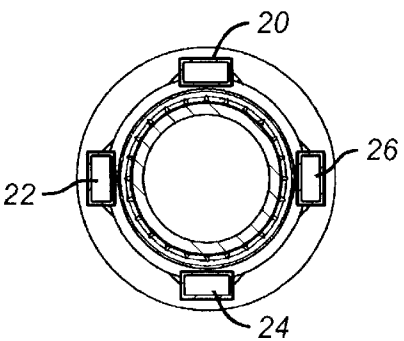
FIG. 2 is a section along lines 2—2 of FIG. 1*a*.
Figure 3:
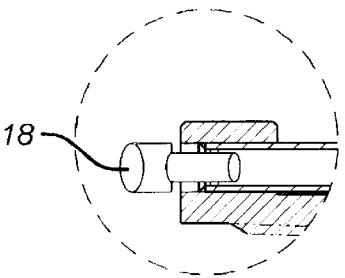
FIG. 3 is a detail showing the top end of one of the transport tubes.

Referring to FIGS. 1*a* through *d*, a series of gravel pack screens 10, 12, and 14 are illustrated as stacked together. The uphole end 16 illustrates that a rupture disc 18 is installed near the top of each of transport tubes, 20, 22, 24 and 26 (see FIG. 2). The rupture disc 18 can be put in any position in any tube 20–26 although the uphole end's preferred. FIG. 2 illustrates four transport tubes disposed at 90°. Those skilled in the art will realize that a greater number or fewer number of transport tubes can be used without departing from the spirit of the invention.

As shown in FIGS. 1*a* through *d*, the transport tubes can have different lengths. Transport tube 20 has a lower end 28 which is higher than the lower end 30 of transport tube 22. The other transport tubes, 24 and 26, would be necessarily longer than transport tubes 20 and 22. In that way the downhole lower end of each of the transport tubes is staggered in a zone represented by screens 10, 12 and 14.

Figure 1B:
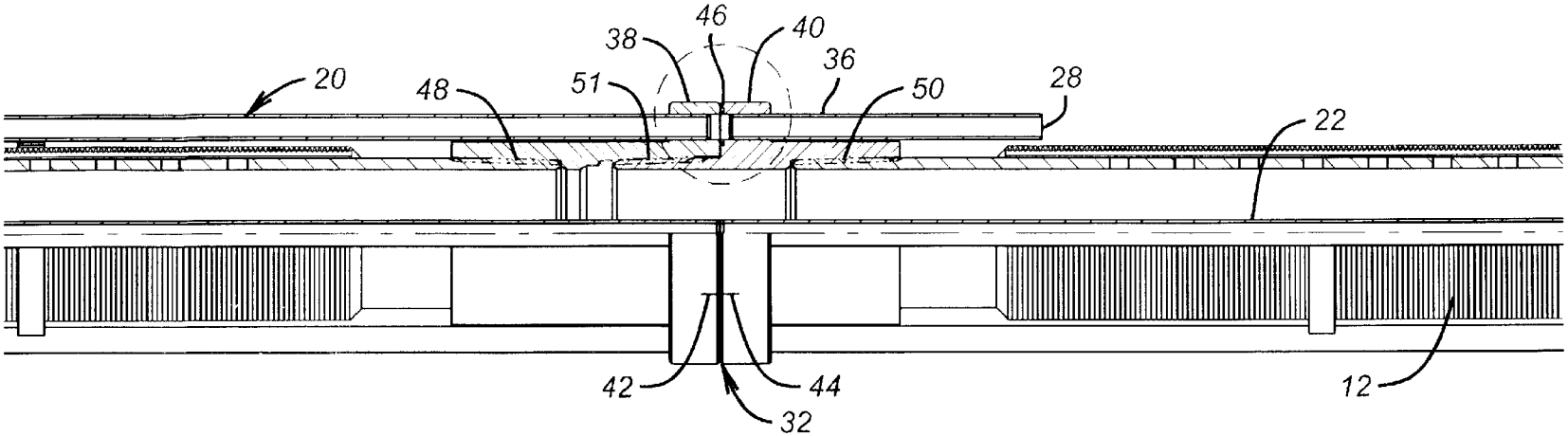
Figure 4:
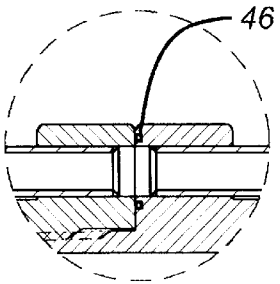
FIG. 4 is a detail of a connection between transport tubes on different sections of pipe.
Figure 1C:
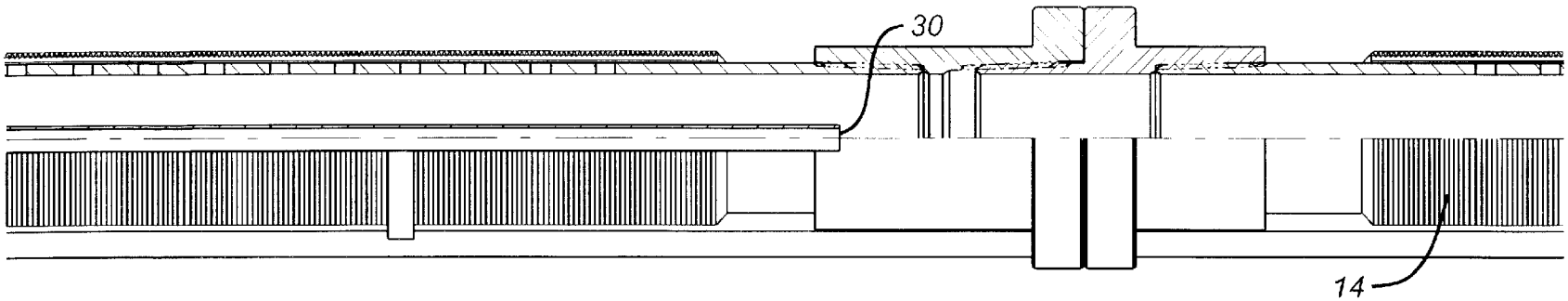
Figure 1D:
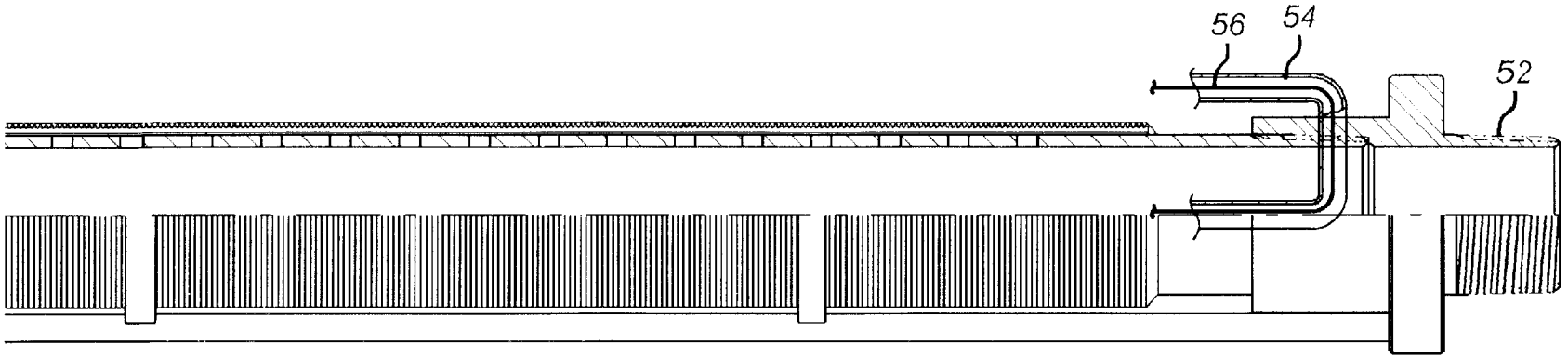

As shown in FIG. 1*b*, here is a connection 32 between screens 10 and 12. Screen 10 has a transport tube segment 34 attached to it on the outside of the screen 10. There is a gap between the tube segment 34 and the screen material of screen 10. Screen 12 has a tube segment 36 which again is attached outside of screen 12. The segments 34 and 36 can extend through hubs 38 and 40 respectively, which form part of the threaded connection 32. There are alignment marks 42 and 44 on hubs 38 and 40, respectively. The threaded connection 32 is made up to align the alignment marks 42 and 44. When that happens, the threaded connection 32 is made up to the requisite torque while the hub segments 34 and 36 are in a sealed engagement. This is due to either metal to metal contact or optionally a seal, shown schematically as 46 can be part of the make-up of hubs 38 and 40. The screen 10 is connected at thread 48 to hub 38 while the screen 12 is connected at thread 50 to hub 40. Connecting the hubs 38 and 40 at thread 5 joins the screens 10 and 12. The same connections repeat when connecting other screens together such as 12 and 14. Those skilled in the art will appreciate that although a connection for one transport tube 20 has been shown. The make-up of hubs 38 and 40 connect mating segments to form a plurality of different transport tubes. In the case of FIG. 1, the joining of hubs 38 and 40 completes another connection on transport tubes 20, 22, 24 and 26. Accordingly, the make up of the connection 32, at thread 51, between two screens such as 10 and 12 can be configured so that when the alignment marks 42 and 44 are aligned, all the transport tube segments align and the entire joint is made up to the predetermined torque which can be a figure which is some optional value based on the yield torque of the materials that form the threaded joint 51. Although the transport tubes 20 and 22 have been shown to have open lower ends 28 and 30, alternative designs are possible where the transport tubes such as 20 and 22 extend all the way to the lower end of the zone, as indicated by a threaded connection 52 in FIG. 1*d*. There, at the lower end, the two transport tubes such as 20 and 22 can be joined together by a U-shaped segment 54. A fiber optic cable 56 can be pumped through the transport tubes 20 and 22 which would be joined together by U-shaped segment 54. It should be noted that the transport tubes can extend along the string as high as is desired, or they can extend only in the region of the formation to be produced in the immediate vicinity of screens 10, 12 and 14. Accordingly, the fiber optic cable 56 would be enclosed in transfer tubes for part of its run and can be left exposed or shielded on the remainder of the string coming to the surface by securing fiber optic cable to the sting as it is being assembled. Additionally, other conductors of power can be run through the transport tubes in lieu of a rupture disc at their upper end.

The rupture disc 18 can be set at different values so that the longest of the transport tubes, i.e., tube 26 would have the rupture disc with the lowest pressure break point. In that manner, the bypassing of gravel pumped down through the transport tubes can apply gravel to lowermost regions first and have a bottom up approach to filling the annular space around the screens 10, 12 and 14. The transport tubes 20 through 26 without rupture disc such as 18 and their upper ends can also be used to convey chemical treatments to the formation or for measuring or monitoring of formation information, and even in gas transport for the purposes of lifting operations. Yet another application of the transport tubes is for conduits for electrical cable for downhole electrical device operations.

In the preferred environment the connection 32 includes a special thread 51 commercially available from Hunting Corporation model number SLHT. This arrangement shown in FIG. 1*b* does not restrict the inside diameter within the screens 10, 12 and 14. Any kind of screen can be used for screens 10, 12 and 14 including an outer shroud made of a variety of designs which can span over the screens 10, 12 and 14 as well as the transport tubes 20 through 26. One such shroud is disclosed in U.S. Pat. No. 5,849,188 which is incorporated herein by reference as if fully set forth.

While a threaded connection 51 including a series of hubs 38 and 40 which align segments 34 and 36 in a sealing arrangement has been disclosed, other types of connections which can allow the joint to be quickly made up while having transport tube segments sealingly aligned is also within the purview of the invention.

Those skilled in the art can readily see the advantages of the present invention. The sections of tubular and/or screen sections can be quickly made up while assuring automatic sealable alignment with transport tube components and make up to the appropriate level of torque simply by virtue of aligning the marks. The use of the rupture disc 18 at the tops of the individual transport tubes keeps them from being clogged up with gravel or proppants before they are needed for use. The staggered level of the break point for the various rupture discs insures a bottom up filling operation of the annular space around the screens 10, 12 and 14 as the longest transport tube has its rupture disc 18 broken first and so forth up until the shortest tubes rupture disc 18 is broken. Multiple perforations in the annular space of the transport tubes is avoided, in the preferred embodiment, because of the potential of infiltration of foreign matter into those openings rendering the various tubes unusable when needed. As shown in FIGS. 1*a* through *d* the lower ends such as 28 and 30 are the only exposed openings to gravel being deposited outside of screens 10, 12 and 14. Accordingly, when there is a bridge or blockage in the delivery of gravel, pressure build up can be used to insure a more complete gravel packing using the transport tubes 20 through 26. Additionally, the fast and easy way to get long sections of transport tubes assembled adjacent a string lend themselves to a variety of applications. The transport tubes can be run to the surface and used as control lines for downhole equipment. They can also act as protective conduits for fiber optic cables or power or signal cables or downhole condition monitoring or operation of downhole components.

It will be understood that the above description has been given by way of illustration and example of the preferred embodiment and not by way of limitation. The claims below describe the scope of the invention claim.

We claim:

1. A tubular connection apparatus comprising:

at least a first tubular having a first bore and a first connection at at least one end and at least a first transport tube segment having an inner and outer wall, out of fluid communication with said first bore, and having a first longitudinal axis, and extending from adjacent said first connection;

at least a second tubular having a second bore and a second connection at at least one end and at least a second transport tube segment having an inner and outer wall, out of fluid communication with said second bore, and having a second longitudinal axis, and extending from adjacent said second connection;

said first and second connections joinable by relative rotation of said first and second tubulars, whereupon said longitudinal axes of said transport tube segments are rotated into sealing alignment when a predetermined torque is applied to secure said first connection to said second connection.

2. The apparatus of claim 1, further comprising:

a sealed fitup between said transport tube segments when said connections are joined by relative rotation.

3. The apparatus of claim 1, further comprising: a plurality of segments of transport tubes on each of said first and second tubulars, pairs of which align as between said tubulars when said tubulars are made up by relative rotation.

4. The apparatus of claim 3, further comprising:

at least said first tubular having a transport tube segment which extends the length of said first tubular such that connection of said second tubular with a corresponding transport tube segment, extends the transport tube formed by said connected segments to beyond said first tubular.

5. The apparatus of claim 3, further comprising:

a plurality of tubulars each with a plurality of segments of transport tubes, such that upon joining said tubulars transport tubes of varying lengths are formed.

6. The apparatus of claim 5, further comprising:

an uppermost segment of a plurality of transport tube segments which, upon makeup of said tubulars, define a transport tube; and a breakable member in said uppermost segment.

7. A tubular connection apparatus comprising:

at least a first tubular having a first connection at at least one end and at least a first transport tube segment extending from adjacent said first connection;

at least a second tubular having a second connection at at least one end and at least a second transport tube segment extending from adjacent said second connection;

said first and second connections joinable by relative rotation whereupon said transport tube segments align when a predetermined torque is applied to secure said first connection to said second connection;

a sealed fit up between said transport tube segments when said connections are joined by relative rotation;

a plurality of segments of transport tubes on each of said first and second tubulars, pairs of which align as between said tubulars when said tubulars are made up by relative rotation; a plurality of tubulars each with a plurality of segments of transport tubes, such that upon joining said tubulars transport tubes of varying lengths are formed;

an uppermost segment of a plurality of transport tube segments which, upon makeup of said tubulars, define a transport tube;

a breakable member in said uppermost segment;

a breakable member disposed in said upper-most segment of each transport tube;

said transport tube with the longest length having a breakable member which breaks first and said transport tube with the shortest length having a breakable member which breaks last, based on an increasing applied force.

8. The apparatus of claim 7, wherein:

said first and second tubulars comprise screens.

9. The apparatus of claim 1, further comprising:

a first and second hub mounted respectively adjacent said first and second connections;

said first and second transport tube segments extending respectively into said first and second hubs;

whereupon makeup of said connections said hubs sealingly contact, with said first and second transport tube segments in a substantial alignment.

10. The apparatus of claim 9, wherein:

said hubs are metal and said sealing contact occurs from metal to metal contact.

11. The apparatus of claim 9, wherein:

one of said hubs comprises a seal which contacts an opposing hub.

12. The apparatus of claim 9, further comprising:

a plurality of tubulars, each having a hub at each end thereof and a plurality of transport tube segments extending at least through one hub on each tubular, whereupon assembly of said tubulars multiple transport tubes are formed of varying lengths.

13. A tubular connection apparatus comprising:

at least a first tubular having a first connection at at least one end and at least a first transport tube segment extending from adjacent said first connection;

at least a second tubular having a second connection at at least one end and at least a second transport tube segment extending from adjacent said second connection;

said first and second connections joinable by relative rotation whereupon said transport tube segments align when a predetermined torque is applied to secure said first connection to said second connection;

a first and second hub mounted respectively adjacent said first and second connections;

said first and second transport tube segments extending respectively into said first and second hubs;

whereupon makeup of said connections said hubs sealingly contact, with said first and second transport tube segments in a substantial alignment;

a plurality of tubulars, each having a hub at each end thereof and a plurality of transport tube segments extending at least through one hub on each tubular, whereupon assembly of said tubulars multiple transport tubes are formed of varying lengths;

at least one of said tubulars comprises a screen.

14. The apparatus of claim 13, further comprising:

a breakable member in each of said transport tubes formed from said joined segments.

15. The apparatus of claim 14, further comprising:

a different setting for breaking of said breakable members so that on increasing applied force, breakable members break in order from the longest transport tube to the shortest.

16. The apparatus of claim 15, wherein:

said transport tubes comprise an uphole end, said breakable members comprise a rupture disc near said uphole end of each said transfer tube.

17. The apparatus of claim 12, further comprising:

a connection between one said transport tube and another such that said transport tubes form a singular u-shaped tube; and a fiber optic cable inserted into said u-shaped tube to communicate downhole conditions.

18. The apparatus of claim 12, further comprising:

a power or signal conductor extending into at least one of said tubes.

19. The apparatus of claim 12, wherein:

at least one of said tubes is connected to a pressure source.

20. The apparatus of claim 1, further comprising:

a breakable member in one of said segments to selectively obstruct it.

21. The apparatus of claim 1 further comprising:

a protective jacket mounted over said tubulars and said segments.

* * * * *